US005423089A

United States Patent [19]

Chun et al.

[11] Patent Number: 5,423,089

[45] Date of Patent: Jun. 13, 1995

[54] GOLF GLOVE

[75] Inventors: Yung Yul Chun, Seoul, Rep. of Korea; Hae K. Joh, Rolla, Mo.

[73] Assignee: Joh Engineering Science Co., Rolla, Mo.

[21] Appl. No.: 149,791

[22] Filed: Nov. 10, 1993

[51] Int. Cl.[6] ..... A41D 19/00

[52] U.S. Cl. ..... 2/161.2; 2/161.4; 2/163; 2/907; 2/161.3

[58] Field of Search ..... 2/159, 161.1, 161.2, 2/161.3, 161.4, 162, 163, 169, 907, 161.8

[56] References Cited

U.S. PATENT DOCUMENTS

| | | | |
|---|---|---|---|
| 2,343,220 | 2/1944 | Mason | 2/168 |
| 2,751,598 | 6/1956 | Romeo | 2/161.3 |
| 3,152,338 | 10/1964 | Strauss | 2/163 |
| 3,387,306 | 6/1968 | Korey | 2/159 |
| 3,394,408 | 7/1968 | Bush | 2/159 |
| 3,548,414 | 12/1970 | Fujita | 2/169 |
| 3,863,271 | 2/1975 | Moroney | 2/161 A |
| 4,051,552 | 10/1977 | Widdemer | 2/161 A |
| 4,329,741 | 5/1982 | Bach | 2/161 A |
| 4,453,275 | 6/1984 | Kawada | 2/161 A |
| 4,514,861 | 5/1985 | Kamada | 2/161 A |
| 4,590,627 | 5/1986 | Connelly | 2/163 |
| 4,691,388 | 9/1987 | Boone | 2/161 A |
| 4,751,750 | 6/1988 | Tepley | 2/161.2 |
| 4,882,787 | 11/1989 | Hull et al. | 2/161 |
| 5,146,627 | 9/1992 | Weiset | 2/161 |

FOREIGN PATENT DOCUMENTS 2308245 9/1974 Germany ..... 2/161.1

*Primary Examiner*—Clifford D. Crowder
*Assistant Examiner*—Michael A. Neas
*Attorney, Agent, or Firm*—Cushman Darby & Cushman

[57] ABSTRACT

A three-fingered golf glove, comprising a middle finger portion, a ring finger portion, and a little finger portion, which has the curvatures of the fingers fully gripping a golf club handle, leaving the thumb and the index finger uncovered; a plurality of fourchettes having external edges; each external edge comprising three segments of straight lines connected by two small joint curved arcs; a curved end side piece having the shape of the lower side of a hand fully gripping a golf club handle; the finger portions, when assembled, having trapezoidal cross-sections; a palm tautening strap being fastened to connect the palm side finger portions and the rear side finger portions while the hand is in a shape fully gripping a golf club handle, forming a loop of tensile force perpendicular to the club axis to completely eliminate bunching and wrinkling at the entire palm section of the glove; a thumb strap forming a force line at the palm portion in the direction parallel to the club axis; reinforcing threads stitched to the palm portion and the palm side and rear side finger portions to strengthen the glove material against being stretched permanently when wet; one or a plurality of thin and flexible friction strips sewn to the palm portion, the sharp corrugations thereon being parallel to the club axis, to maintain the increased anti-twist resistance of the glove; even when the glove is fully wet with rain or perspiration.

16 Claims, 7 Drawing Sheets

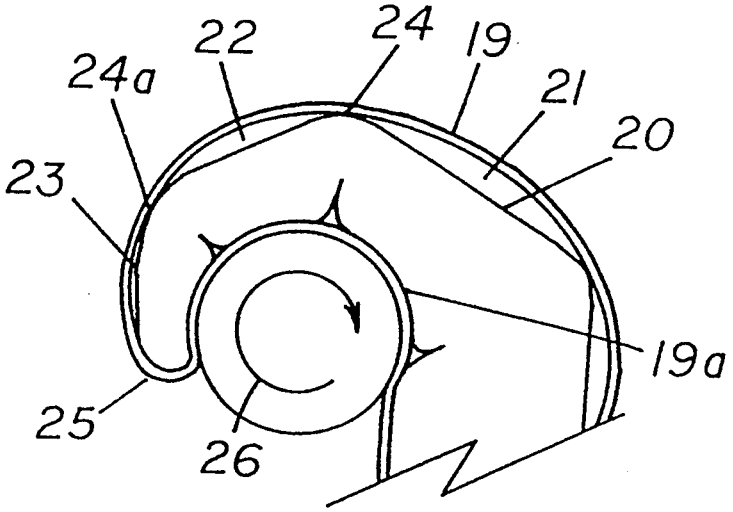
FIG. 1 PRIOR ART
FIG.2a PRIOR ART
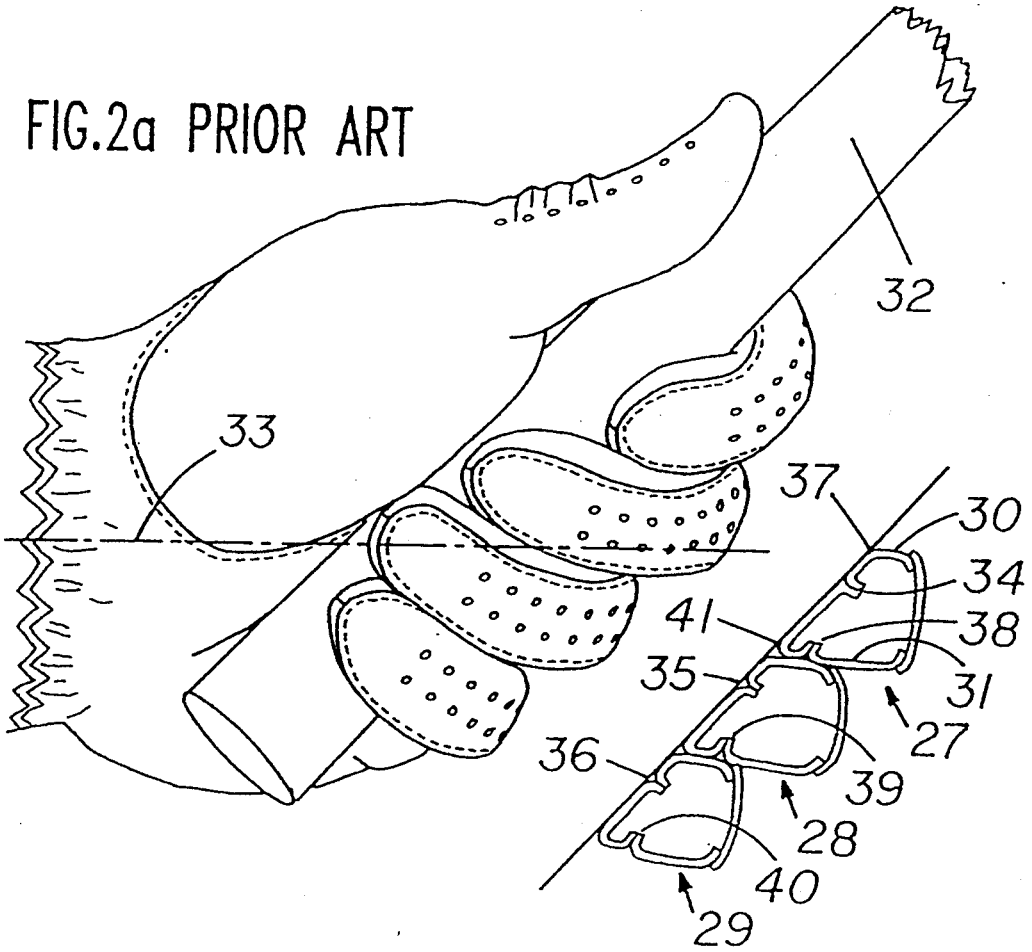
FIG.2b PRIOR ART

FIG.3a
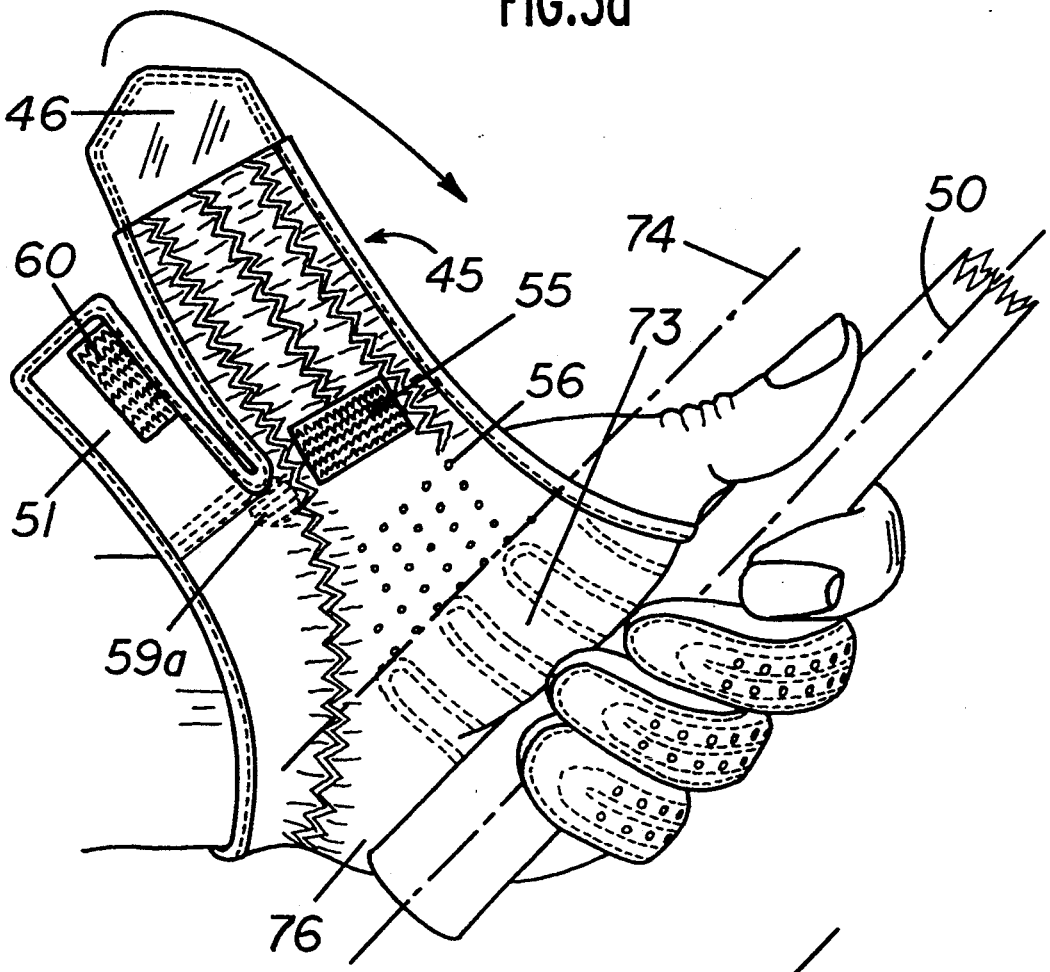
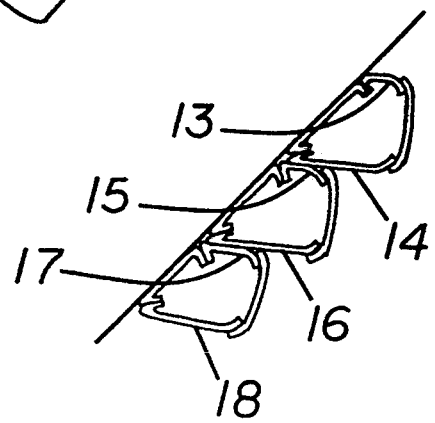
FIG.3b

GOLF GLOVE

BACKGROUND OF THE INVENTION

The present invention relates generally to sport gloves and, more specifically, to golf gloves.

Generally, the conventional golf gloves have been designed and manufactured in similar ways, such that the gloves fit the hand and the fingers stretched straight. These designs have originated from the thousand-year-old multi-purpose design, the major function of which was to protect the hand from cold or from being injured. The glove was originally used in golf as a means of blister protection at the palm-side skin of hand and also to reduce slippage between the hand and the golf club handle caused by perspiration.

In golf, the primary function of a glove should be m enhance the gripping efficiency of the hand. From the mechanics point of view, however, the multi-purpose design has a few serious problems which cannot be solved satisfactorily by surface coating techniques or partial modifications of the design.

When a golf club handle is gripped by a hand wearing such a glove, the palm sides of the glove and hand are compression-buckled, bunching and forming wrinkles of various sizes, while the rear side of the glove is stretched. Since the bunches and wrinkles, being formed generally parallel m the major axis of the gripped golf club handle, are easily shear-deformed, the anti-twist resistance of the glove and hand, which is essential to a good golf swing, is significantly deteriorated. Also, the rear-side stretching of the glove lowers the gripping efficiency, because the tensile force in this stretched side of the glove acts in the opening mode for the hand.

Another problem with the conventional designs is the slippage between the palm side of the hand and the palm side inner surface of the glove or between the palm side outer surface of the glove and the club handle surface. With highly frictional materials recently developed for the club handle and gloves, slippage between the palm side outer surface of a glove and the club handle surface has become a minor problem when the contact surfaces are dry. However, when the gloves are wet with rain or perspiration, the coefficient of friction of these surfaces is lowered significantly, because the water acts like a lubricant between the palm skin of the hand and the inner surface of the glove, or between the outer surface of the glove and the golf club handle. When the club shaft is subjected to twisting torque during the swing motion or at impact, the glove material bunched and wrinkled with the palm skin of the hand is separated from the palm, unfolds, and glides on the palm skin of the hand, allowing the club handle to be twisted, riding the glove material, in the same direction as the twisting torque on the shaft, while slipping occurs also between the golf club handle and the glove. Feeling the inefficient gripping effect with such a glove, the golfers instinctively apply an unnecessarily large force to the gripping hand, which makes the forearm and the wrist less flexible and reduces the club head speed in the long run. Many golfers still choose to play golf bare-handed unless their hands are blistered, because wearing a multi-purpose-design glove actually makes gripping less force-efficient and more inconsistent.

One of the solutions to the bunching and wrinkling problem was to use a VELCRO fastener to produce a tight-fitting feel. In this method of prior art gloves, however, the glove is not tightened and fastened in the direction perpendicular to the golf club handle gripped in the hand, but in the direction perpendicular to the axis of the wearer's forearm. It makes little contribution to alleviate the bunching and wrinkling problem but tightly chokes the hand in the wrong direction just to hamper the hand from light-force gripping and to make the golfer apply a larger force to the hand than is needed.

More advanced attempts to overcome the palm portion bunching and wrinkling problem can be found in other prior arts, as shown in U.S. Pat. Nos. Mason 2,343,220, Fujita 3,548,414, Widdemer 4,051,552, Kawada 4,453,275, Weiser 4,590,627, and Connelly 5,146,627. In particular, Widdemer first introduced the curved fourchettes to the Mason's previous art, and then Kawada attempted to reintroduce the same idea with some additions. In their arts, however, they failed to embody the fact that each finger consists of the three straight and rigid pieces of bones connected at the three joints. When the hand is bent to grip a rod, each finger is bent only at the three joints, leaving the other portions straight. The simply-curved fourchettes of Widdemer or Kawada do not contour the piece-wise linear rear portion profile of each bent finger. When a glove is made to have a small curvature at the finger portion, this problem of geometric incompatibility does not seem to be pronounced. However, as a glove is made to have a larger curvature, the finger portions of the glove are segregated further from the fingers at the rear portions between the joints,as shown in FIG. 1. If the finger portions of the glove are fabricated to have the same curvature as the hand and fingers fully gripping a golf club handle, the glove with the fourchettes of Widdemer or Kawada is completely detached away from the fingers at the rear side finger portion between the joints, and totally loses the tautness which is essential to golf gloves. Consequently, the invention of Widdemer has been limited, in theory as well as in practice, to gloves with relatively small curvatures of fingers and hand.

The second shortcoming of the art of Widdemer or Kawada is that the glove is not designed to have prebending at the first joint of each finger, as opposed to the fact that the hand is also bent at the first joints. When a golf club handle is gripped, the extents of bending in all the fingers are nearly the same at the second joints and the third joints, respectively, while, only at the first joints, the degree of bending increases in sequence from the index finger toward the little finger. However, instead of using the long end side pieces, fully extending from the wrist edge to the tips of the index finger and the little finger, with all the joint portions contouring the shape of the bent rear portions of the hand and the two fingers fully gripping a golf club handle, Widdemer and Kawada either used the short end pieces or only varied the curvatures of the fourchettes.

The third shortcoming of the art of Mason or Widdemer is that the palm portion which is made shorter than the rear portion, can be stretched longer by repeated usage, thereby allowing bunching again in the palm area.

In golf, gloves are not generally worn in pairs. The golf glove is used on one hand, usually the left hand, which grips the club closer to the club handle tip, because this hand plays the major role of the anti-twist gripping of a golf club handle. The other hand does not need any blister protection or grip reinforcement because its role is insignificant as far as the anti-twist gripping is concerned. However, closely examining the roles of the hand wearing a glove, one can find out that the blister protection or grip reinforcement is not needed for the entire hand, as the primary gripping action against twisting is achieved only by the middle finger, ring finger, little finger, palm heel pad, and the butt at the base of the thumb, while the role of the remaining parts of the hand is not vital any more than the role of the other hand.

Initially, conventional gloves were introduced into golf because gloves were the only means available for blister protection, and then, it was later pointed out by many inventors that, due to the bunching and wrinkling phenomena at the palm portions of the glove and hand, the conventional gloves were inadequate for the purpose of gripping a golf club handle. Moreover, both golfers and glove designers have not recognized the fact that what they need for a grip aid is a specialized glove exclusively designed for the single purpose of gripping rather than a multipurpose full-hand coveting glove. The preconception that a grip aid should have the conventional shape of a full-hand covering glove has deterred improvements in the design of golf gloves for many years.

There have been various attempts to make semi-gloves which do not have finger tip portions. However, it is well known that, without the tip portions of the middle finger, ring finger, and little finger, a golf glove significantly loses its function as a grip aid.

When a golf club handle is gripped by a gloved hand, the handle is generally placed on the palm portion and the palm side of finger portions diagonally from the hand heel pad to the pad between the second and third joints of the index finger. The other three fingers helically wrap around the golf club handle, and in the conventional gloves, the seams connecting the front portions of the fingers and the upper side fourchettes facing the thumb are placed directly in the compressive contact region between the fingers and the surface of the golf club handle, making the wearer feel uncomfortable.

Fujita attempted to solve this problem, as shown in U.S. Pat. No. 3,548,414, by using the curved seaming edges convex toward the index finger in the proximity of the second joints of the palm side finger portions. However, since Fujita used the same width for the fourchettes on both sides of each finger and kept the palm side finger portions straight from the third joints to the tips, the completed fingers of the glove were twisted in such a manner that the seam line between the upper side fourchette and the rear portion of each finger is moved laterally toward the middle of the second joint region on the rear side of the finger where the pressure exerted by the glove material on the hand is very high. The wearer of the glove would feel uncomfortable because of the twisting of the finger portions of the glove and the seams pressing down on the rear side skin of the fingers. Kamada also attempted to solve the same problem, as shown in U.S. Pat. No. 4,514,861, by pre-twisting the finger portions of the glove when the fourchettes are sewn to the palm side and rear side finger portions. However, Kamada's design also has the same shortcomings as those of Fujita, because both upper and lower side fourchettes are made to have the same width.

When a hand is gripping a golf club handle, as illustrated in FIGS. *2a* and *2b*, the cross-sections, of the three fingers at the regions between the first and third joints are deformed into the trapezoidal shapes, which will clearly show that the upper side fourchettes should be made narrower than the lower side fourchettes in order to avoid the aforementioned problem, and that the fingers are not actually twisted. If the finger portions of golf gloves are made in this manner, the seam lines would pass through the four apexes of each trapezoid and would not directly come into the compressive contact region between the fingers and the club handle surface.

SUMMARY OF THE INVENTION

The present invention comprises a novel glove design by which the aforementioned problems of the prior art gloves are satisfactorily solved. To be more specific, the present invention combines a plurality of unique features, including three finger portions for the middle finger, ring finger, and little finger, with the thumb and index finger uncovered; each of said three finger portions having a curvature of the finger fully gripping a golf club handle; a plurality of fourchettes having external edges and internal edges; each of said external edges comprising the three segments of straight lines being connected by two short arcs having the external contours of bent joints of the corresponding finger fully gripping a golf club handle and each of said internal edges having a curvature of palm side of the corresponding finger fully gripping a golf club handle; said finger portions, when assembled, having trapezoidal cross-sections, wherein the upper side fourchettes are narrower and the lower side fourchettes are wider than the conventional fourchettes at the portions between the first and third joints; an end side piece having the shape of the lower side edge of a hand fully gripping a golf club handle; a palm tautening strap connecting the palm side finger portions and the rear side finger portions forming a loop of tensile force perpendicular to the club axis to completely eliminate bunching and wrinkling at the entire palm section of the glove; a thumb strap and two wrist straps forming a force loop around the wrist and a force line at the palm portion parallel to the club axis; said palm and rear side finger portions and said palm tautening strap being stitched by reinforcing threads to be protected from being stretched permanently when wet; one or a plurality of thin friction strips with corrugated surfaces being sewn to the palm portion to maintain the anti-twist resistance of the glove even when the glove is fully wet.

In a preferred embodiment, it is extremely easy to wear the glove; first the three fingers are inserted to the finger portions through the completely open space before the straps are fastened, and then, fully gripping a golf club handle, the straps are fastened, in sequence, the palm tautening strap, the wrist straps, and then the thumb strap. A good feel of the golf club motion is achieved through the uncovered thumb and index finger, and also by the grip curved finger portions and palm portions without bunching or wrinkling. The trapezoidal cross-sections of the finger portions permit the wearer to have a comfortable feeling, since the seam lines are moved away from the compressive contact regions. By the increased anti-twist resistance of the glove, the wearer is allowed to grip a golf club handle by using a minimum force, which produces, as a result, the effects of increased head speed and better control of the grip pressure.

OBJECTS OF THE INVENTION

It is a principal object of the present invention to provide a novel golf glove, wherein the palm portions of the glove are structured not to have bunching or wrinkling, and which enables the wearer to grip the golf club handle very securely against twisting in any circumstances with a very small force applied to the hand.

It is an additional object of the present invention to provide an improved golf glove comprising three finger portions for the middle finger, ring finger, and little finger, which play the primary role in the anti-twist gripping of the golf club handle, leaving the thumb and index finger uncovered to enhance the direct feel of the club motion and facilitate tautening of the palm portion, and also to make it easy and convenient to wear and remove the glove.

It is a further object of the present invention to provide an improved golf glove comprising the palm and rear side finger portions connected by a palm strap, which is designed to be stretched taut and fastened in such a manner that the force loop is formed in the plane perpendicular to the club axis of the golf club handle gripped in the hand.

Yet another object is to provide a golf glove comprising the palm portion stitched by the reinforcing threads aligned in the direction generally perpendicular to the club axis to significantly protect the glove material from being stretched permanently when wet with rain or perspiration.

It is still an additional object of the present invention to provide a golf glove comprising the palm and rear side finger portions stitched by the reinforcing threads along the vent holes thereon to strengthen the finger portions against being stretched permanently when wet.

It is still an additional object of the present invention to provide a golf glove which allows the golfer to fit the glove to his or her own grip characteristics by using the straps designed to be fastened taut only when the hand has taken the shape fully gripping a golf club handle.

It is a further object of the present invention to provide an improved golf glove which allows the wearer to achieve the anti-twist resistance to the same extent even when the glove is fully wet as when the glove is dry.

BRIEF DESCRIPTION OF THE DRAWINGS

The aforementioned objects and advantages of the present invention will be more fully understood hereinafter as a result of the following detailed description of the invention when taken in conjunction with the following drawings:

FIG. 1 is a cross-sectional schematic view of a finger portion of a prior art golf glove constructed with simply-curved fourchettes and a finger holding a golf club handle, illustrating the geometric incompatibility between the simply curved rear side finger portion of the glove and the piece-wise linear profile of the rear portion of the fingers fully gripping a golf club handle;

FIG. 2*a* is a perspective view of a glove in accordance with a prior art worn on a user's hand fully gripping a golf club handle;

FIG. 2*b* is a cross-sectional view for each of the three finger portions of the prior art glove of FIG. 2*a* at the region between the first and third joints, illustrating the trapezoidal shapes of the cross-sections with the seam lines placed in the compressive contact zones;

FIG. 3*a* is a perspective view of the glove in accordance with the present invention worn on a user's hand gripping a golf club handle, illustrating that the hand must completely be in the shape fully gripping a golf club handle prior to fastening of the fastening means;

FIG. 3*b* is a cross-sectional view for each of the three finger portions of the glove illustrated in FIG. 3*a*, showing that the trapezoidal cross-sections formed by the narrowed upper side fourchettes and the widened lower side fourchettes allow the seam lines to pass through the four apexes of each trapezoid;

DETAILED DESCRIPTION OF THE INVENTION

Figure 4:
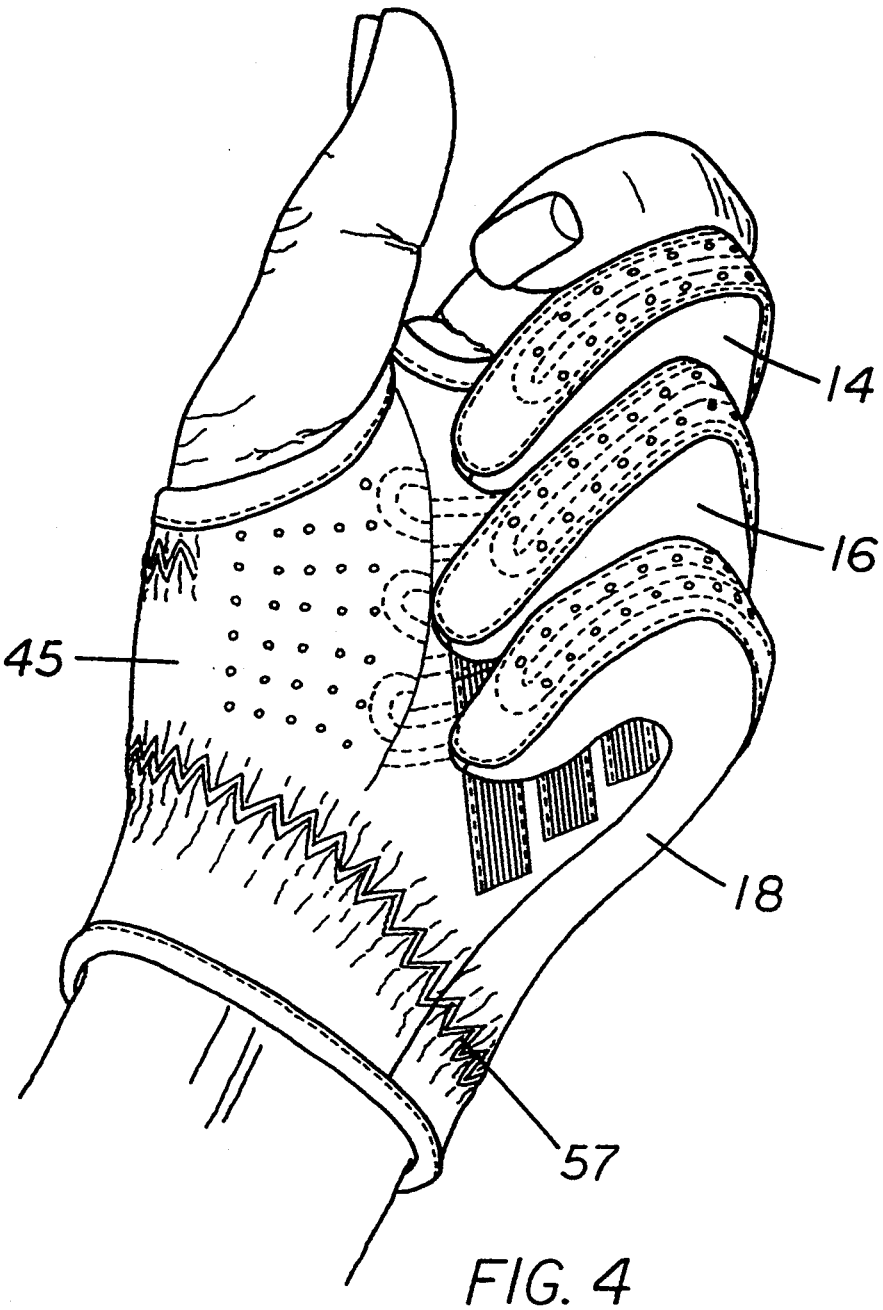
FIG. 4 is a perspective view of the glove in accordance with the present invention worn on a user's hand, showing the lower side fourchettes and the end side piece.
Figure 5:
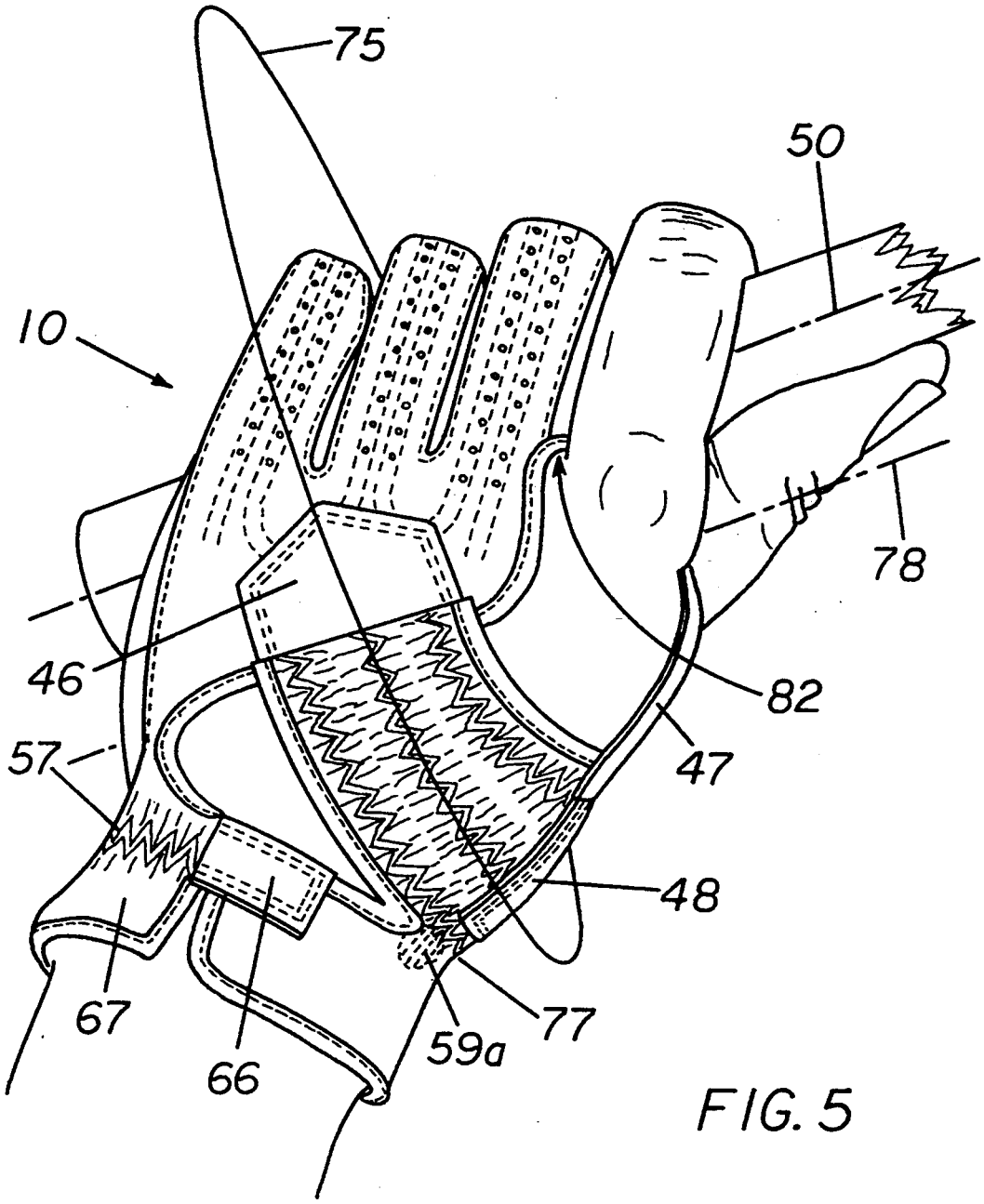
FIG. 5 is a perspective view similar to FIG. 4, illustrating the fastened positions of the fastening means, loop of force, and the line of force formed on the glove when the hand is fully gripping a golf club handle.
Figure 6:
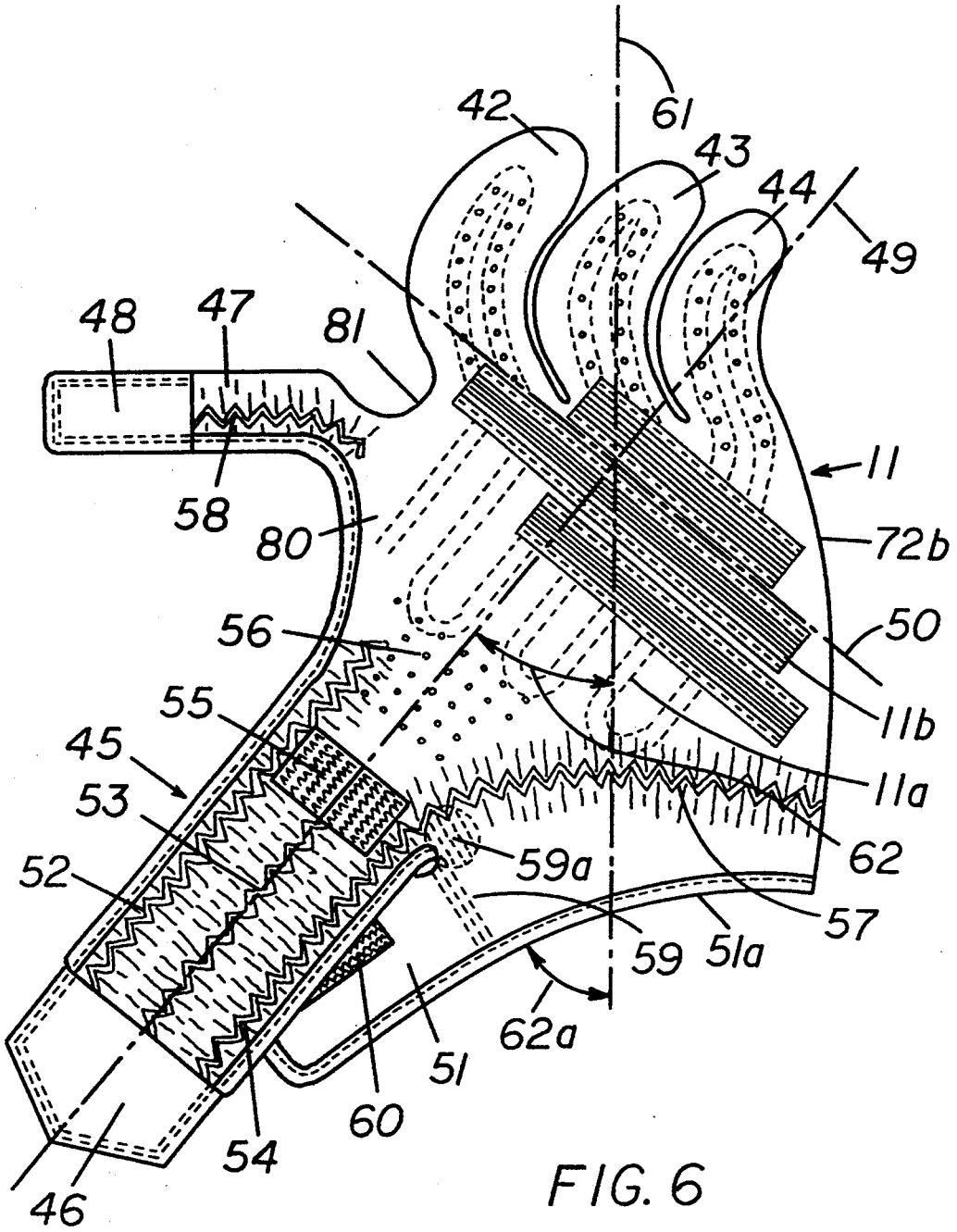
FIG. 6 is a plan view of the palm section of the glove with a palm tautening strap, embodying the present invention prior to being sewn with the fourchettes and the rear section of the glove.
Figure 7:
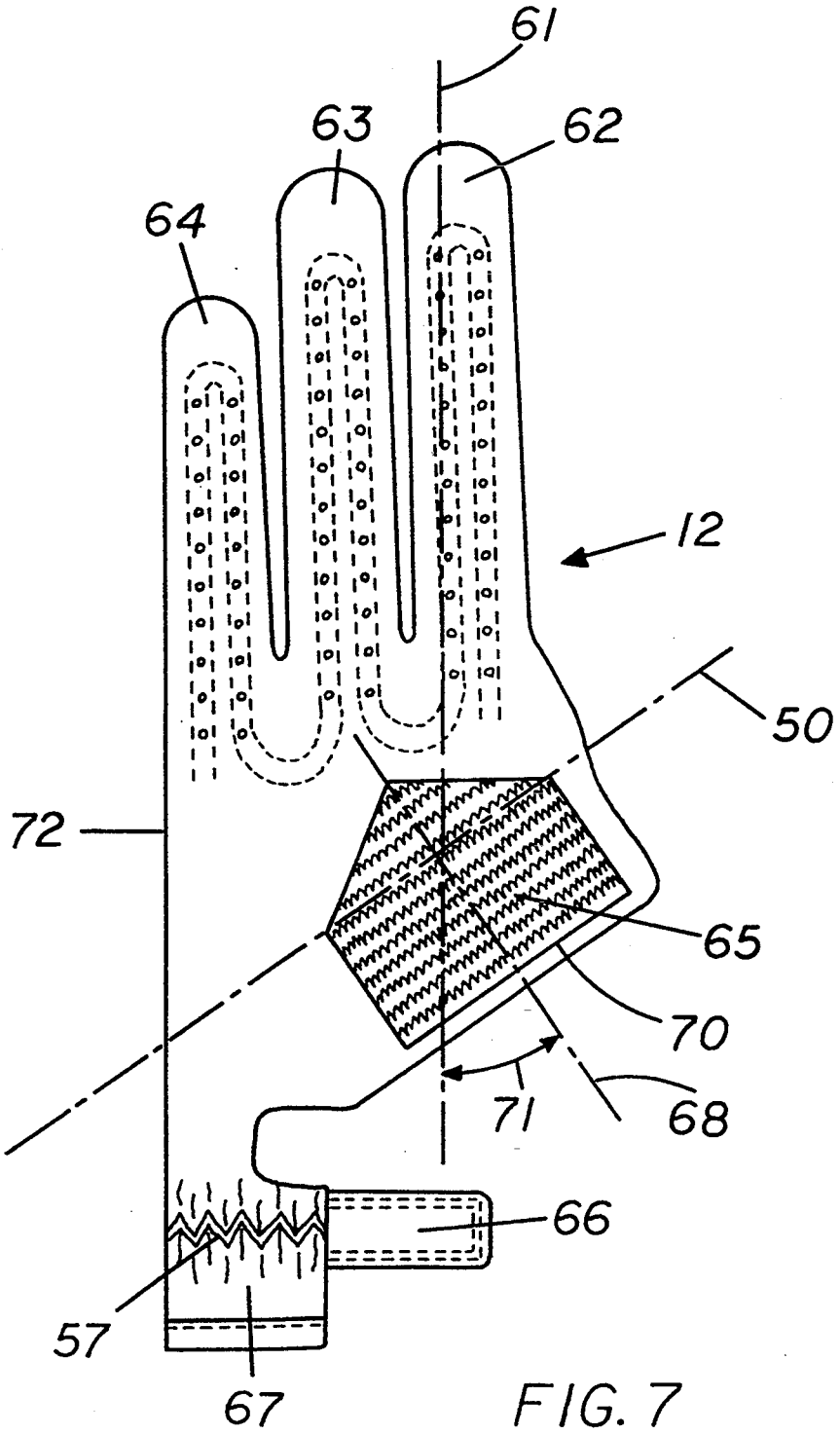
FIG. 7 is a plan view of the rear section of the glove characterizing the diagonally aligned edge of the fastening means generally in the direction parallel to the club axis.
Figure 8A:
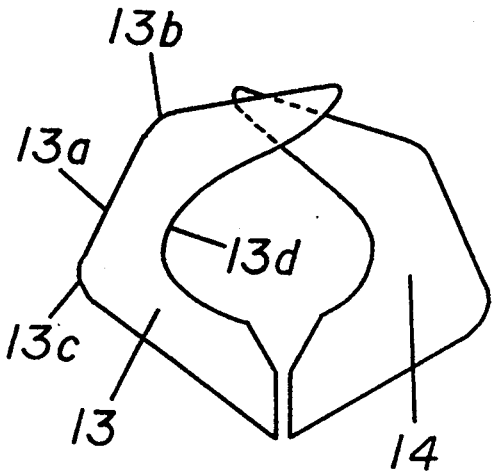
FIG. 8*a* is a plan view of the fourchettes for the middle finger.
Figure 8B:
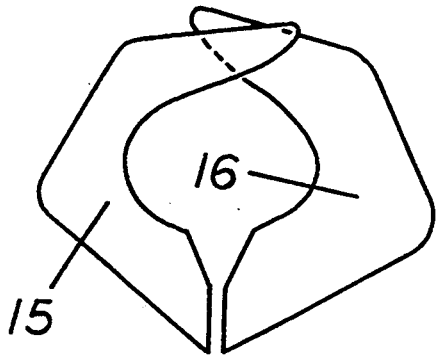
FIG. 8*b* is a plan view of the fourchettes for the ring finger.
Figure 8C:
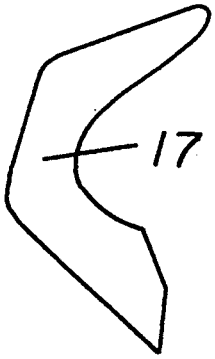
FIG. 8*c* is a plan view of the upper side fourchette for the little finger.
Figure 8D:
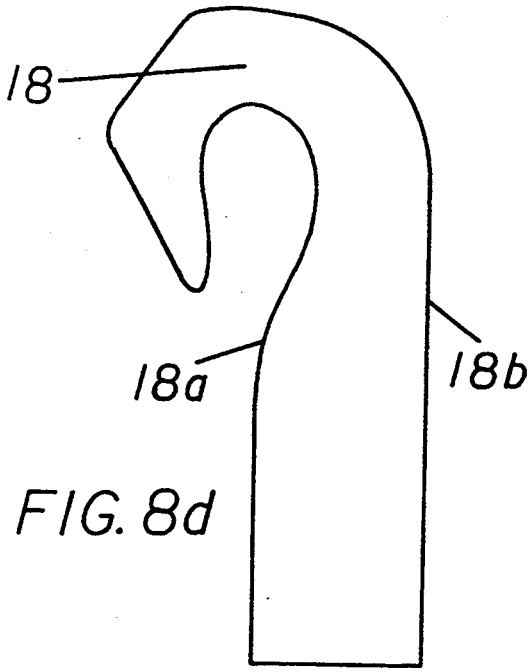
FIG. 8*d* is a plan view of the end side side piece for the little finger.

A preferred embodiment of the present invention is shown in FIGS. 3*a*, 4, and 5 which are the perspective views of the left-hand three-fingered glove 10 for a right handed golfer. The thumb and index finger portions are removed for an unimpeded feel of the motion of the gripped golf club. It will be seen that golf glove 10 can be worn and fastened only after the hand has been formed into the shape fully gripping a golf club handle. Golf glove 10 comprises a palm section 11, as shown in FIG. 6, a rear section 12, as shown in FIG. 7, and fourchettes 13–17 and end side piece 18, as shown in FIGS. 8*a*–8*d*.

As illustrated in FIG. 1, the geometric incompatibility between the rear side finger portion 19 of a prior art glove having simply-curved fourchettes and the actual rear side profile 20 of the fingers fully gripping a golf club handle imposes restrictions on the increase of the curvature of finger portions to follow the true grip curve. Since the rear side finger portion generally touches the finger only at joint portions 24 and 24*a*, voids 21, 22, and 23 are formed between the glove and the finger to impede taut fitting which is essential to golf gloves. In golf gloves, the tip portion 25 of the fingers, one of the most important parts for anti-twist gripping, must always fit the finger tips tightly to provide proper gripping action for the golf club against being twisted in direction 26. With prior art gloves, when the club is subjected to torque in direction 26, the excessively loose glove material on the rear side of the fingers is readily pulled around the finger tips toward the front side, allowing the club to ride on the glove material and be twisted with little resistance. In addition, since rear side finger portion 19 is not tightly secured on the rear side of the finger 20, the fourchettes connected to both sides of said rear side finger portion 19 can be readily pulled by palm side finger portion 19*a* in the directions tangent to the cylindrical surface of the golf club handle, permitting said palm side finger portion 19*a* to be dragged with little resistance in direction 26 by the golf club handle being twisted.

The practical way employed in the prior art gloves to avoid such a problem has been to use the fourchettes with a smaller curvature and let the rear side finger portions of the glove be stretched taut as the curvature is increased when the hand is fully gripping a golf club handle. However, it is inconsistent with the claim or claims of said prior art gloves, since stretching of the rear side finger portions and wrinkling of the palm side finger portions occur as the result of the difference between the designed curvature and the grip curvature. Also, the fitting is less taut than the conventional golf gloves having straight finger portions because said geometric incompatibility is not completely eliminated even by the stretching of the rear side finger portions.

To solve the problem of limited curvature of the prior art gloves and achieve precisely the full-grip curvature without said shortcomings, a plurality of fourchettes 13–17 and the end side piece 18, as shown in FIGS. 8*a*–8*d*, are utilized. Taking the upper-side fourchette 13 for the middle finger as an example, the external contour 13*a* comprises three segments of straight lines connected by two small joint-curved arcs, 13*b* and 13*c*, embodying the fact that the fingers are bent at the joints only and other portions always remain straight. The internal contour 13*d* of the fourchette is the same as the external contour of the gripped golf club handle. The same argument can also be extended to other fourchettes.

When a hand is gripping a golf club handle, the hand is also bent at the knuckles or the first joints of the fingers. However, this fact cannot be embodied by a glove without using the end side pieces for the upper side of the index finger and the lower side of the little finger, fully extending from the finger tips to the wrist edge of the glove and contouring the side, shapes of the hand fully gripping a golf club handle. In the three-fingered glove of the present invention, using only the end side piece 18 on the lower side of the little finger is sufficient to define the overall shape of the glove worn on a hand fully gripping a golf club handle.

FIG. 2*b* shows a cross-sectional view for each of the three finger portions of the glove at the region between the first and third joints. Since the fingers are compressed in the direction of forearm axis 33 while being pushed against golf club handle 32, which is gripped diagonally in a hand, the cross-sections of the fingers are deformed into trapezoidal shapes, 27,28, and 29, and the seam lines, 34,35, and 36, between the upper side fourchettes and the palm side finger portions, are placed in the compressive contact zones between the club handle surface and the fingers. In addition, the seam lines 38,39, and 40, between the lower side fourchettes and the palm side finger portions, are placed on the lower sides of the trapezoids. These problems were not addressed in the design of prior art golf gloves, and the claimed advantages of the simply-curved fourchettes or the partly curved edges of the palm side finger portions were not practically achieved, because the design configuration was different from the actual configuration of the deformed fingers.

In the present invention, upper side fourchettes, 13,15, and 17, are made narrower and the lower side fourchettes, 14 and 16, and the end side piece 18, are made wider than those of the prior art gloves, respectively, as shown in FIGS. 3 and 8*a*–8*d*, to be in compliance with the deformed trapezoidal cross-sections of the fingers. More specifically, taking the middle finger 27 of FIG. 2*b* as an example, upper side fourchette 30 and lower side fourchette 31 have the same width in prior art gloves. However, in the present invention, seam line 34 is moved to the new position 37, and seam line 38 is moved to the new position 41. Consequently, as shown in FIG. 3*b*, the seam lines are placed to pass through the four apexes of each trapezoid to make the upper side fourchettes narrower and the lower side fourchettes wider than the counterparts of the prior-art gloves, respectively, especially at the regions between the first and third joints of each finger.

The palm section 11, as shown in FIG. 6, comprises a middle finger portion 42, a ring finger portion 43, a little finger portion 44, a palm tautening strap 45, a thumb strap 47, and a wrist strap 51. The palm side finger portions are sufficiently short to be integral with the internal edges of the fourchettes, and the side edges thereof are curved to be convex toward the index finger over the entire length of each finger portion. Palm tautening strap 45 extends and is stretchable from the palm in the direction of principal line of force 49, which is generally perpendicular to club axis 50 of the fully gripped golf club handle. It also includes; a plurality of elastic means 52,53, and 54, and fastening means 46 and 55. One of the three elastic means 54 is connected with wrist elastic means 57 and is extended to the rear section 12 of the glove across edge 72*b* and end side piece 18. The edge 72*b* is sewn to internal edge 18*a* of end side piece 18. Palm tautening strap 45 also includes a plurality of holes 56 for the advantage of ventilation. Thumb base cover portion 80 is established as a means of blister protection for the portion in the proximity of the first joint of the thumb on the side facing the index finger. Thumb strap 47 includes an elastic means 58 and a fastening means 48, which will be fastened to its counterpart fastening means 55 on said palm tautening strap 45 when the glove is worn. The hollow section 81 protects the seam between the palm side middle finger portion and the upper side fourchette for the middle finger from being torn apart directly by the force transmitted from thumb strap 47. A wrist strap 51 is provided separately with a fastening means 60 and sewn to palm section 11 along triple seam lines 59 so as to be partly overlaid with palm tautening strap 45 when the glove is not in use. A reinforcing pad 59*a* is sewn securely at the inner side of the junction between the palm tautening strap and the palm portion wrist strap 51 to protect the junction cleavage from being propagated through the palm portion of glove by the force acting in a tearing mode when the glove is worn. A curved wrist edge 51*a* is directed at a varying angle 62*b* in the range of about 50 degrees to about 90 degrees relative to firearm axis 61.

Said palm section 11 is stitched by reinforcing threads 11*a* in the direction generally perpendicular to club axis 50 and along the vent holes on the palm side finger portions to significantly protect the glove material from being stretched permanently when wet with rain or perspiration.

Since the principal line of force 49 of palm tautening strap 45 is generally perpendicular to club axis 50 of the golf club handle fully gripped in a hand, the angle 62 between the principal line of force 49 and forearm axis 61 is approximately 40 degrees, with the possible variations of about +20 and −20 degrees. The principal line of force 49 can also be directed at a continuously varying angle in the same range as aforementioned.

One or a plurality of thin and flexible friction strips 11*b* is sewn to the palm portion of the glove to increase the anti-twist resistance of the glove significantly. Both surfaces of the strip or strips lib have sharp corrugations parallel to club axis 50, which bite into the surfaces of the golf club handle and the glove to apply an anti-twist torque to the golf club very effectively, cooperated by the tautness of palm tautening strap 45. The enhanced anti-twist resistance is not reduced even when the golf glove is fully wet with rain or perspiration.

The rear section 12, as shown in FIG. 7, comprises a middle finger portion 62, a ring finger portion 63, a little finger portion 64, fastening means 65 and 66, and a wrist strap 67 with an elastic means 57, which is connected to the elastic means 54 on palm tautening strap 45 across end side piece 18. The edge 70 of fastening means 65 is generally parallel to club axis 50 and perpendicular to principal line of force 68 of palm tautening strap 45 when fastened. The rear side finger portions are sufficiently long to be integral with the piece-wise linear external edges of the fourchettes. The edge 72 is sewn to external edge 18*b* of end side piece 18. The angle 71 between principal line of force 68, which is generally perpendicular to club axis 50, and forearm axis 61 is approximately 40 degrees, with the possible variations of about +20 and −20 degrees. The rear side finger portions are also stitched with reinforcing threads along the vent holes thereof to strengthen the material against being stretched permanently when wet.

The golf glove of the present invention, when assembled, can be worn only when a hand is in a shape fully gripping a golf club handle. Since the glove does not have the thumb and index finger portions, it is extremely easy to insert the middle finger, ring finger, and little finger into the three finger portions of the glove through the completely open space before the straps are fastened. Then a golf club handle is gripped exactly to the wearer's own grip characteristics with palm section 11 secured on the palm and stretched in the direction of force line 49 perpendicular to club axis 50, as shown in FIG. 3*a*. While the golf club handle is gripped in the same manner, with the thumb stretched straight along the club handle, palm tautening strap 45 is wrapped around the oval shaped thumb butt 73 at the base of the thumb, maintaining the tension in the direction of force line 49. Since the major axis 74 of the oval shaped thumb butt is generally parallel to club axis 50 when a golf club handle is fully gripped, principal force line 49 is generally maintained perpendicular to club axis 50 during this wearing procedure. At thumb butt 73, being cooperated by the highly deformable property of the glove at the portion with a plurality of vent holes 56, palm tautening strap 45 is readily formed into the oval shape of the thumb butt. Also, the elastic means on palm tautening strap 45 provide the freedom of lateral motion thereof, allowing a minor variation in the direction of force line 49 for an individual adjustment, as palm tautening strap 45 is wrapped around the thumb butt.

When palm tautening strap 45 is fastened, as shown in FIG. 5, a force loop 75 is formed in a plane generally perpendicular to club axis 50, and the tensile force along this loop pulls the palm side finger portions and the rear side finger portions toward the first joints there of, keeping the finger tip portions to fit taut. Above all, what is unique in the present invention is the advantage that the palm section of the glove is kept taut with a certain magnitude of tensile force acting in the direction perpendicular to club axis 50 even when the hand is gripping a golf club handle, not to mention that the palm section is free of bunching or wrinkling.

When a wrist fastening means 66 is pulled to fasten the wrist straps, elastic means 57 is stretched to apply an additional tautness to heel pad portion 76. The wrist straps also establish a structural stability for the subject glove, when worn on a hand, preventing palm tautening strap 45 from being slipped over the position 77 toward the thumb tip. A fastening means 48 on thumb strap 47 being fastened to a fastening means 55 on the worn palm tautening strap, force line 78 is established on the palm portion of the glove in the direction parallel to club axis 50, which further enhances the structural stability of the glove on the hand because the palm portion of the glove is better secured on a hand when the palm portion is tightened in the two mutually perpendicular directions. A reinforcing pad 82 is sewn securely along the open edge across the seam lines connecting the upper side fourchette of the middle finger, the rear side middle finger portion, and the palm side middle finger portion.

A unique golf glove has been disclosed, comprising the three fully grip-curved finger portions, a palm tautening strap with a unique line of force, a thumb strap, wrist straps, and one or a plurality of friction strips. It will now be apparent to those knowledgeable in the art that the piece-wise linear rear portion contours and the trapezoidal cross-sections of the fingers enable one to manufacture a fully grip-curved glove, and that the palm tautening strap which is stretched normally to the club axis actively generates a tensile force at the entire palm portion of the glove, completely eliminating the possibility of bunching and wrinkling in any circumstances. It is the applicants knowledge that no other attempts have been made so far in the prior arts to establish a force line generally perpendicular to the club axis. The fully grip-curved glove of the present invention is a novel concept which cannot be expanded directly from the concepts of the prior art gloves.

Additionally, an unimpeded feel of the golf club motion is obtained by using the narrowed upper-side fourchettes and widened lower-side fourchettes at the region between the first and third joints, thereby moving the seam lines to the apexes of said trapezoidal cross-sections. The unimpeded feel is also obtained by the uncovered thumb and index finger. The advantage of the thin friction strip or strips secured on the palm portion is valid only when the palm portion of the glove is designed to be taut under a tensile stress acting in the direction perpendicular to the club axis, which cannot be achieved by the prior art gloves when the hand is fully gripping a golf club handle. By the increased anti-twist resistance of the glove, the wearer is allowed to grip a golf club handle by using a minimum force even when the glove is fully wet, which produces, as a result, the effects of increased head speed and better control of the ball's direction.

As a result of the disclosure herein, various modifications and variations of the present invention will now become apparent to those skilled in the art. It is preferred, therefore, that the present invention be limited not by the specific disclosure herein, but only by the appended claims.

We claim:

1. A golf glove for being worn on a hand extending from a forearm of a wearer, for fully gripping a handle of a golf club, the forearm and handle having respective longitudinal axes, said golf glove comprising:

a palm section having a palm portion and a plurality of palm side finger portions including a middle finger portion, a ring finger portion, and a little finger portion; each said finger portion having side edges, said side edges of said ring and little finger portions being convex towards said middle finger portion, and said side edges of said middle finger portion being convex in a same direction as said side edges of said ring and little finger portions over the entire lengths of said portions, said palm section having a palm-tautening strap extending from said palm portion; said palm section having a thumb strap extending away from a junction between said palm side middle finger portion and said palm-tautening strap in a direction substantially perpendicular to the longitudinal axis of the wearer's forearm; said thumb strap having a thumb strap fastening means and a thumb strap elastic means said palm section having a palm section wrist strap being sewn to the palm portion between said palm tautening strap and a palm section wrist edge;

a rear section having a back hand portion and plurality of rear side finger portions including, in sequence, a middle finger portion, a ring finger portion, and a little finger portion; said rear section having a rear section fastening means, with an edge thereof being generally parallel to the longitudinal axis of the club handle when the handle is fully gripped by the wearer; said rear section having a rear section wrist strap extending from said back hand portion and having a rear portion fastening means secured thereon; said rear section wrist strap terminating at a rear section wrist edge;

a plurality of fourchettes each having an external edge and an internal edge; each said external edge being sewn to one edge of a corresponding one of said palm side finger portions;

an end side piece having an external edge and an internal edge; said external edge of said end piece being sewn to a lower side edge of said rear side little finger portion and to an edge of said back hand portion from finger tip to rear section wrist edge; said internal edge of said end side piece being sewn to a lower of said side edge of said palm side little finger portion and to said palm side palm portion from finger tip to palm section wrist edge;

said palm-tautening strap having a plurality of elastic means; one of said elastic means being adjacent to said palm section wrist edge and being extended across said end side piece to the rear section wrist strap; said palm-tautening strap having a fastening means secured at an end edge thereof to be fastened to said rear section fastening means; said palm-tautening strap having another fastening means thereon, being secured proximate a junction between said palm-tautening strap and said palm section wrist strap to be fastened by the thumb strap fastening means on said thumb strap.

2. A golf glove as set forth in claim 1, wherein each of said fourchettes has an external edge defining three generally straight segments being connected by two short arcs, each fourchette having a contour of a corresponding finger fully gripping a golf club handle.

3. A golf glove as set forth in claim 1, wherein upper side ones of said fourchettes have a narrowed width at a portion between first and third joints, and each lower side ones of said fourchettes and said end side piece has a widened width at the portion between said first and third joints so as to fit the shape of each finger, the cross-section of each of the fourchettes being deformed into a generally trapezoidal shape when the fingers are fully gripping a golf club handle.

4. A golf glove as set forth in claim 3, wherein each said finger portion has seam lines passing through four apexes of each said trapezoidal cross-section so that the seam lines are placed along the edges of compressive contact regions between the fingers.

5. A golf glove as set forth in claim 1, wherein said external edge of said end side piece comprises, in sequence extending away from said finger tip, two straight line segments and a large outwardly convex arc connected by two short arcs having contours of bent joints of the little finger, and a long straight line segment connected smoothly and extended to said wrist edge; said internal edge of end side piece comprising, in said sequence, an inwardly concave arc generally defined by an external curvature of the gripped golf club handle, an inwardly convex arc and a straight line segment, being connected smoothly to be extended to said wrist edge.

6. A golf glove as set forth in claim 1, wherein said palm tautening strap has a principal axis directed at an angle generally perpendicular to the club axis and directed at an angle in the range of about 20 degrees to about 60 degrees relative to the axis of the wearer's forearm.

7. A golf glove as set forth in claim 6, wherein said palm tautening strap connects said palm side finger portions and said rear side finger portions with tautness when the hand is in a shape fully gripping a golf club handle, forming a force loop in a plane generally perpendicular to said club axis, thereby completely eliminating bunching and wrinkling of the glove at the palm portion when a golf club handle is fully gripped.

8. A golf glove as set forth in claim 1, wherein said palm portion has at least one thin and flexible friction strip having opposite surfaces, both surfaces thereof having a plurality of sharp corrugations generally parallel to said club axis of the golf club handle when fully gripped in a hand to maintain high friction with the club handle even when the glove is wet.

9. A golf glove as set forth in claim 1, wherein said thumb strap is fastened in such a manner that a tensile force line is formed on the palm portion in a direction generally parallel to said club axis to enhance stability of the glove on the wearer's hand.

10. A golf glove as set forth in claim 1, wherein a plurality of vent holes in said palm tautening strap are aligned in a plurality of rows parallel to said club axis, facilitating said palm tautening strap to contour an oval shaped thumb butt.

11. A golf glove as set forth in claim 1, wherein a reinforcing pad is sewn securely at an inner side of said junction between the palm tautening strap and the palm portion wrist strap to protect the glove from tearing thereat when the straps are fastened.

12. A golf glove as set forth in claim 11, wherein another reinforcing pad is sewn securely along an open edge across seam lines connecting an upper side fourchette of the middle finger, the rear side middle finger portion, and the palm side middle finger portion.

13. A golf glove as set forth in claim 1, wherein said palm side finger portions have a plurality of vent holes aligned parallel to the curved edges thereof.

14. A golf glove as set forth in claim 1, wherein said palm portion is stitched by reinforcing threads aligned in the direction generally perpendicular to the club axis to protect the glove material from being stretched permanently when wet with rain or perspiration; the palm and rear side finger portions being stitched by reinforcing threads along vent holes provided therein to strengthen the finger portions from being stretched permanently when wet.

15. A golf glove as set forth in claim 1, wherein said palm tautening strap has a thumb base cover portion established as a means of blister protection in proximity of a first joint on the side of a thumb facing the index finger.

16. A golf glove for being worn on a hand extending from a forearm of a wearer, for fully gripping a handle of a golf club, the forearm and handle having respective longitudinal axes, said golf glove comprising:

a palm section having a palm portion and a plurality of palm side finger portions including a middle finger portion, a ring finger portion, and a little finger portion; each said finger portion having side edges, said side edges of said ring and little finger portions being convex towards said middle finger portion, and said side edges of said middle finger portion being convex in a same direction as said side edges of said ring and little finger portions over the entire lengths of said portions, said palm section having a palm-tautening strap extending from said palm portion; said palm section having a palm section wrist strap being sewn to the palm portion between said palm tautening strap and a palm section wrist edge;

a rear section having a back hand portion and plurality of rear side finger portions including, in sequence, a middle finger portion, a ring finger portion, and a little finger portion; said rear section having a rear section fastening means, with an edge thereof being generally parallel to the longitudinal axis of the club handle when the handle is fully gripped by the wearer; said rear section having a rear section wrist strap extending from said back hand portion; said rear section wrist strap terminating at a rear section wrist edge;

a plurality of fourchettes each having an external edge and an internal edge; each said external edge being sewn to one edge of a corresponding one of said palm side finger portions;

an end side piece having an external edge and an internal edge; said external edge of said end piece being fixed to a lower side edge of said rear side little finger portion and to an edge of said back hand portion from finger tip to said rear section wrist edge; said internal edge of said end side piece being sewn to a lower of said side edges of said palm side little finger portion and to said palm side palm portion from finger tip to palm section wrist edge;

said palm-tautening strap having elastic means and fastening means secured at an end edge thereof to be fastened to said rear section fastening means.

* * * * *